United States Patent [19]

Kandler

[11] Patent Number: 4,926,808

[45] Date of Patent: May 22, 1990

[54] PRIMER BULB CHECK VALVE SYSTEM FOR AN INTERNALLY VENTED BOWL PRIMER CARBURETOR

[75] Inventor: William C. Kandler, New Holstein, Wis.

[73] Assignee: Tecumseh Products Company, Tecumseh, Mich.

[21] Appl. No.: 363,627

[22] Filed: Jun. 8, 1989

[51] Int. Cl.[5] ..... F02M 1/16

[52] U.S. Cl. ..... 123/187.5 R; 261/72.1; 261/DIG. 8; 92/92

[58] Field of Search ..... 123/187.5 R; 261/DIG. 8, 72.1; 92/92

[56] References Cited

U.S. PATENT DOCUMENTS

| | | | |
|---|---|---|---|
| 3,307,836 | 3/1965 | Arndt et al. | 261/34 |
| 4,197,825 | 4/1980 | Altenbach | 123/187.5 R |
| 4,203,405 | 5/1980 | Schultz et al. | 123/187.5 R |
| 4,323,522 | 4/1982 | Rasmussen | 261/72.1 |
| 4,404,933 | 9/1983 | Kuczenski | 123/187.5 R |
| 4,411,844 | 10/1983 | Morris et al. | 261/34.1 |
| 4,679,534 | 7/1987 | Guntly et al. | 123/187.5 R |

*Primary Examiner*—Andrew M. Dolinar

*Attorney, Agent, or Firm*—Jeffers, Hoffman & Niewyk

[57] ABSTRACT

A carburetor for an internal combustion engine is provided. The carburetor float bowl is internally vented through a venting path that leads from the carburetor throat, via the primer chamber, to the airspace above the float bowl. An annular lip is provided on the primer bulb that acts as a check valve and seals off the venting passageway when the primer bulb is depressed, thereby insuring that the primer charge passes into the float bowl and is not lost through the venting passageway.

15 Claims, 1 Drawing Sheet

PRIMER BULB CHECK VALVE SYSTEM FOR AN INTERNALLY VENTED BOWL PRIMER CARBURETOR

BACKGROUND OF THE INVENTION

The present invention relates generally to carburetors for internal combustion engines, and more specifically to carburetor primer mechanisms for use in internally vented float bowl carburetors.

In small internal combustion engines, and in particular those engines which are started by hand cranking, it is frequently desirable to prime the engine by introducing a fuel-rich mixture into the engine intake system to aid in starting the engine. Such priming arrangements are particularly desirable for use in internal combustion engines of the type which are commonly used in lawnmowers, snowblowers and the like, that are likely to be started either infrequently or in cold weather.

Known priming arrangements are frequently in the form of an operator actuable bulb which, when depressed, displaces a volume of air into the airspace above a carburetor float bowl or fuel well. This air exerts pressure on the fuel which forces the fuel upwardly through a conduit into the venturi, where it is mixed with air and then drawn into the intake manifold of the engine. Such priming arrangements are well known in the art and include, for example, U.S. Pat. Nos. 4,197,825; 4,203,405; 4,404,933 and 4,679,534; all assigned to the assignee of the present invention. The first two patents listed above illustrate priming arrangements wherein fuel is displaced from a fuel well, whereas the latter two patents illustrate priming arrangements wherein the air displaces fuel from the float bowl.

In general, well type priming arrangements are considered inferior to float bowl type arrangements. A problem associated with well priming systems is that, after a priming operation, fuel is only slowly replaced in the well. Therefore, if the operator attempts to prime the engine in rapid succession, no fuel is present in the well after the first priming operation so that the only effective priming operation is the first such operation. Furthermore, each prime is limited to the volume of the well, which is quite small compared to the bowl. In a float bowl type of primer, such as that found in the present invention, the volume of the priming charge may be as large as the volume of air displaced from the primer bulb. Since the primer bulb is either wholly or partially external to the carburetor body, it may therefore have a relatively large volume, which thereby permits concomitantly larger primes with each depression.

In small internal combustion engines having float bowl priming arrangements, the primer is generally activated when the operator depresses a primer bulb which displaces a volume of air into the airspace above the float bowl. Pressure exerted by this air upon the fuel in the bowl causes fuel to be forced upwardly through a nozzle into the fuel/air mixture passage, or venturi, from which this rich fuel/air mixture is drawn into the intake manifold to aid in starting the engine. After the engine has been started, a continuous flow of fuel from the bowl to the venturi must be provided in order to assure smooth operation of the engine. Therefore, it is necessary to provide a means for venting the airspace above the float bowl. This venting may be either internal whereby the air supply to the vent is drawn from the throat of the carburetor, or external whereby the venting air is supplied from the atmosphere external to the carburetor. In the past, certain problems have arisen with regard to the venting of the float bowl which have hindered the efficient operation of the engine. For example, a disadvantage associated with both internally and externally vented carburetor float bowls is that a portion of the air forced into the float bowl as a result of the priming charge escapes through the venting passage, and thus is not available to perform useful work in displacing fuel from the float bowl into the fuel/air mixture passage. Thus, the effectiveness of the priming charge has been diluted.

Additional disadvantages have been associated with the use of externally vented float bowls. For example, when the airspace above the float bowl is externally vented to the outside atmosphere there is a likelihood that contaminant dirt and water particles will be introduced into the carburetor through this vent. These contaminants may eventually clog the fuel and air passageways, and thus prevent the smooth flow of fuel to the venturi. Externally vented float bowls have been reported in the prior art that include air filters and cleaners in an attempt to solve the problems associated with contaminants entering the carburetor. Although these filters and cleaners may be successful in preventing the entry of contaminants into the carburetor, they must be frequently cleaned and/or replaced which requires an undesirable amount of time to be spent on maintenance of the engine. A further disadvantage to externally vented carburetors is that when the air cleaner becomes dirty and clogged, the difference between the air pressure in the carburetor throat and the ambient air pressure will cause the engine to run rich. Accordingly, it is preferred to employ an internally vented float bowl which avoids the above-described problems.

Internally vented float bowls have also been known in the art. Internally vented carburetor bowls are advantageous with respect to externally vented bowls in that the vent passageway leads from the space above the fuel in the bowl to the throat of the carburetor. Thus, when the air cleaner becomes clogged and the pressure within the carburetor throat decreases, the pressure above the fuel in the float bowl also decreases due to the passageway connecting the carburetor throat and bowl. This prevents rich operation of the carburetor. Internally vented bowls have a further advantage over externally vented float bowls because the air that is supplied to the vent comes from the interior of the engine, and thus has already passed through the carburetor air filter. Thus, the likelihood of introducing additional contaminants into the carburetor of an internally vented float bowl carburetor is greatly reduced.

Prior art internally vented bowls, however, generally have a venting passageway that leads directly from the bowl to the throat area of the carburetor. Thus, as previously discussed, a portion of the priming charge will escape from the airspace above the float bowl through this internal vent, thereby diluting the effectiveness of the primer. In order to attempt to eliminate this loss of priming charge, the type of internal vent that is generally found in the art is necessarily of small diameter in order to hinder this loss of the priming charge. It is difficult to calibrate this type of carburetor due to bowl vacuum created because of the small diameter vent.

It is desired to provide a vent for a carburetor that is effective in venting a float bowl or fuel well, but does not introduce contaminants into the carburetor or require frequent maintenance of the air filter. Further, it is desired to provide a vent for a carburetor that provides effective venting of the float bowl or fuel well to near atmospheric pressure, yet does not allow the priming charge to escape through the venting aperture or cause difficulties in the calibration of the carburetor.

SUMMARY OF THE INVENTION

The present invention overcomes the problems associated with the venting of prior art carburetors by providing an improved internally vented carburetor float bowl arrangement. Since the carburetor is vented internally, the venting air is drawn from the throat of the carburetor and the engine will not run rich when the air cleaner becomes clogged. Furthermore, the problems associated with externally vented carburetors, such as the introduction of contaminants into the system and/or the increased maintenance required to clean or replace the vent air filter, are avoided. In addition, the problems previously encountered with internally vented carburetors are also eliminated.

With the carburetor of the present invention, the venting passageway to the float bowl is arranged so that it does not interfere with or reduce the effectiveness of the primer charge. As previously described, with prior art carburetors of this type, a portion of the primer charge would ordinarily escape through the venting passageway before it had performed useful work in forcing the fuel from the bowl to the venturi.

The present invention provides for a carburetor having a venting passageway leading from the throat of the carburetor into the primer bulb cavity in the carburetor body. The passageway is then linked to the airspace above the float bowl through the conventional primer passageway. Thus, the venting air originating from the carburetor throat directly communicates, via the primer bulb cavity, with the airspace above the float bowl. Thus, a suitable vent is provided. The venting passageway is situated so that it is sealed off when the primer bulb is depressed by the operator, thus preventing the loss of primer charge before it performs its intended function of increasing the air pressure upon the fuel on the float bowl. The primer bulb includes an annular lip situated on an inner portion of the bulb. The annular lip acts as a check valve when the bulb is depressed by sealing off the venting passageway from the primer chamber and the priming passageway.

One advantage of the present invention is that it provides an effective vent for a carburetor bowl that includes a check valve so that the priming charge is not lost through the vent.

Another advantage of the present invention is that it provides an internally vented bowl carburetor whereby dirt and other contaminants are not introduced into the carburetor through the vent opening.

A further advantage of the present invention is it provides an internally vented carburetor that requires less maintenance than prior art carburetors because air cleaner service intervals are greatly extended over those intervals obtained with the use of prior art externally vented carburetors.

Yet another advantage of the present invention is that it provides a vent for a carburetor float bowl that is effective in operation, yet is relatively simple in construction and economical to manufacture.

Still another advantage of the present invention is that the annular sealing surface arrangement provides a relatively large venting area. Therefore, the vent is less likely to be obstructed by contaminant dirt particles compared to prior art venting arrangements.

The present invention, in one form thereof, provides a carburetor for providing fuel/air mixture to an internal combustion engine. The carburetor comprises a carburetor body having a throat formed therein, whereby the throat defines a fuel/air mixture passage through the body. The carburetor further comprises a fuel supply bowl, and includes conduit means for conveying fuel from the fuel supply bowl to the throat. In addition, a variable volume primer chamber is provided, and a priming passageway is provided that leads from the primer chamber to the fuel supply bowl. Operator actuable primer means are provided for abruptly reducing the volume of the chamber and displacing a discrete volume of air from the chamber through the priming passageway into the bowl. A venting passageway is included which extends from the throat to the priming chamber.

The present invention, in one form thereof, further comprises a carburetor for providing a combustible fuel/air mixture to an internal combustion engine. The carburetor comprises a carburetor body having a throat formed therein, said throat defining a fuel/air mixture passage through said body. A float regulated fuel supply bowl adapted to contain a quantity of liquid fuel and having an airspace above the fuel is provided, along with a fuel nozzle to provide fuel to the mixture passage. An air-filled variable volume primer chamber is provided, said chamber being defined in part by a recessed area projecting inwardly from a surface on the carburetor body. A priming passageway extends from the recessed area of the chamber to the airspace in the fuel supply bowl. A venting passageway extends from the carburetor throat to the primer chamber. The venting passageway communicates with the primer passageway so that the fuel supply bowl is internally vented to the throat. A flexible resilient manually operable bulb defining a portion of the wall of the chamber is provided. The bulb is adapted to be depressed to abruptly reduce the volume of the chamber and cause a discrete volume of air from the chamber to pass through the priming passageway into the airspace. The bulb further includes valve means for sealing the venting passageway from the primer chamber when the bulb is depressed.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
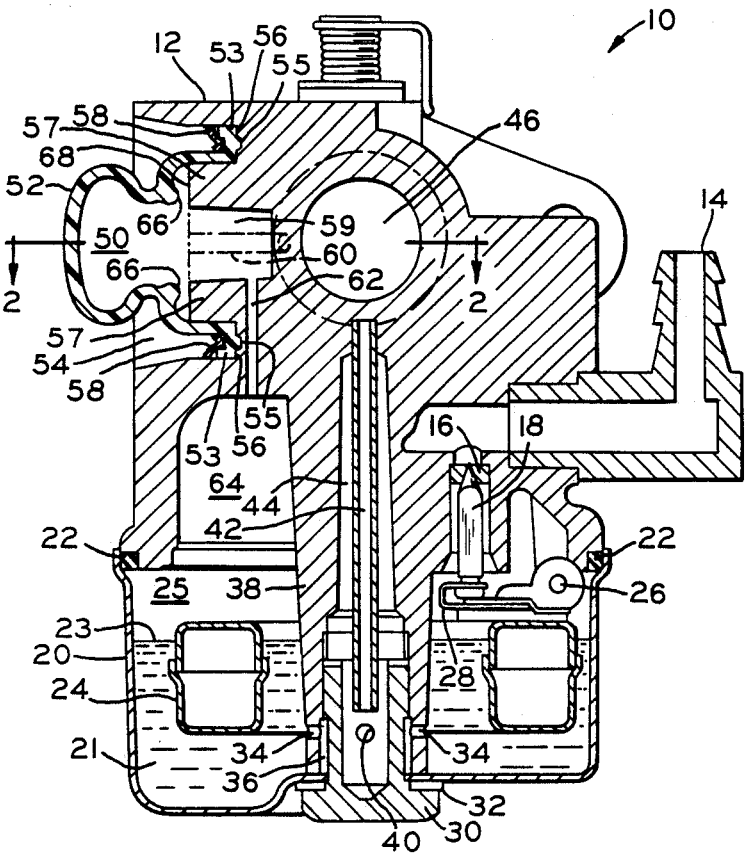
FIG. 1 is a cross sectional view of a carburetor employing the priming and venting system of the present invention.
Figure 4:
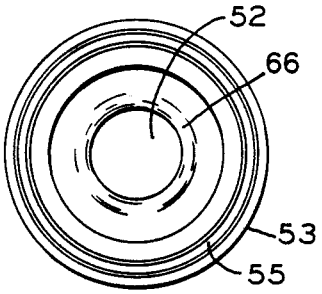
FIG. 4 is an end view of the primer bulb of the present invention.

Referring to the drawings, and particularly to FIG. 1, there is shown a carburetor 10 for providing a combustible fuel/air mixture to a conventionally aspirated internal combustion engine. Carburetor body 12 has a fuel inlet passage 14 for admitting fuel to the carburetor by gravity flow or by way of fuel pump from a fuel supply tank (not shown). A fuel inlet valve arrangement is shown including an inlet seat 16 and an inlet needle 18. A float regulated fuel supply bowl 20 receives fuel 21 which passes into bowl 20 from the fuel supply tank through the aforementioned fuel inlet valve arrangement. Airspace 25 occupies the volume of bowl 20 above fuel level 23. Float bowl 20 is attached to hollow columnar portion 38 of carburetor body 12 by means of bowl nut 30 and washer 32. Screw threads may be provided on an upper portion of bowl nut 30 to form a threaded connection with hollow columnar portion 38, or other conventional attachment means may be utilized. O-ring 22 is provided to seal the connection between float bowl 20 and carburetor body 12.

Annular float 24 is pivotably supported on float pivot pin 26. Float 24 is connected to inlet needle 18 by means of inlet needle clip 28. As fuel is admitted into bowl 20, float 24 will pivot upwardly about float pivot pin 26, and carry inlet needle clip 28 and inlet needle 18 upwardly. Inlet needle 18, at a certain point in its upward movement, will close off the fuel inlet supply by seating on inlet seat 16. As fuel is consumed by the engine, fuel level 23 in float bowl 20 decreases. Float 24 then pivots downwardly, thereby unseating inlet needle 18 from inlet seat 16 and admitting further fuel into bowl 20.

Figure 2:
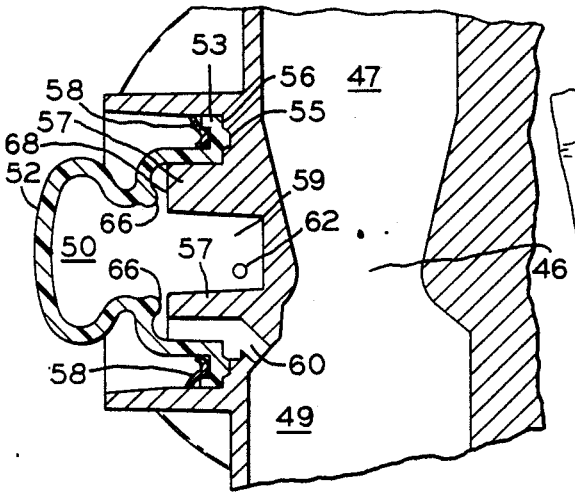
FIG. 2 is a sectional view along the line 2—2 of FIG. 1, showing the primer bulb in its normal position, wherein the venting passageway is open to the primer bulb chamber.
Figure 3:
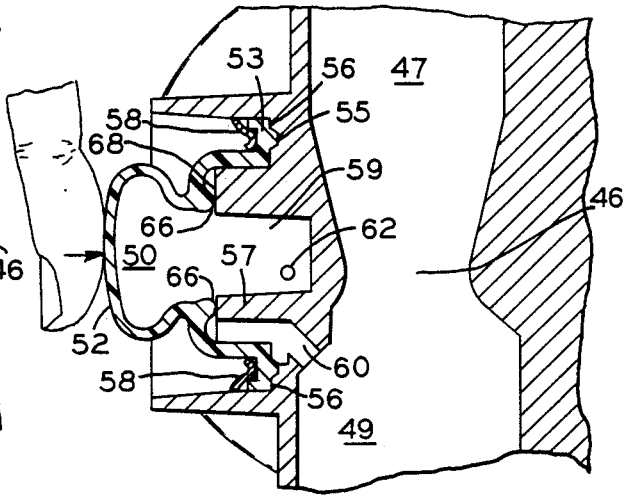
FIG. 3 is a sectional view similar to FIG. 2, wherein the primer bulb has been depressed by the operator, thereby closing off the venting passageway from the primer chamber.

Fuel 21 from float bowl 20 is introduced into carburetor body 12 through, for example, one or more fill orifices 34. The fuel then passes into intermediate region 36 disposed between bowl nut 30 and hollow columnar portion 38. One or more metering holes 40 in bowl nut 30 allow fuel to pass from intermediate region 36 into conduit 42, which extends axially upwardly through the interior of nozzle 44. Fuel is drawn upwardly through conduit 42 into the fuel/air mixture passage at venturi 46 by means of the lower pressure that exists in the region of the venturi, compared to that in fuel bowl 20. During normal engine operation, when air flows through the constricted region of venturi 46, it is at a pressure lower than atmospheric pressure. At the same time, the pressure in airspace 25 directly above fuel level 23 in float bowl 20 is at essentially atmospheric pressure. Airspace 25 remains at essentially atmospheric pressure as a result of the internal venting of the carburetor, in a manner to be discussed hereinafter. The pressure differential between airspace 25 and venturi region 46 causes fuel 21 to be forced upwardly through conduit 42 into venturi 46, which is disposed in a constricted region of carburetor throat 47, as shown in FIGS. 2 and 3. The fuel then enters the airstream of carburetor throat 47, and is mixed therein to provide the fuel/air mixture that is drawn into the engine during normal operation. The direction of air flow through this portion of carburetor throat 47 is indicated by the arrows in FIG. 2.

A variable volume primer chamber 50 is provided. Preferably chamber 50 is formed by sealingly seating a resilient air impervious bulb 52 in a pocket 54 in carburetor body 12. Bulb 52 is manually compressible and is preferably made of a resilient rubber-like material. In the embodiment shown in the drawings, bulb 52 includes annular flange 53 having a seating ring 55. Flange 53 and ring 55 are seated in an annular groove 56 formed in the base of pocket 54. Flange 53 is retained in groove 56 by suitable sealing means such as primer bulb retainer ring 58. Primer limiter boss 57 is defined in pocket 54 by annular groove 56, and has a generally cylindrical recessed area 59 disposed therein as shown in FIGS. 1–3. Primer chamber 50 includes the airspace within primer bulb 52 as well as the air within recessed area 59.

Primer chamber 50 communicates with choke bore region 49 of carburetor throat 47 through venting passageway 60, as shown in FIGS. 2–3, and by dotted lines in FIG. 1. Venting passageway 60 may be formed by a drilled and/or cast passage from choke bore region 49 through an outer portion of primer limiter boss 57 to primer chamber 50 (FIGS. 2, 3). Primer chamber 50 also communicates with airspace 25 in float bowl 20 through priming passageway 62. Priming passageway 62 is drilled in carburetor body 12 from recessed area 59 to airspace 25, and may include a larger diameter opening 64 directly above airspace 25. Thus, it may be readily observed from FIGS. 1–2 that choke bore region 49 of carburetor throat 47 is in communication with airspace 25 via venting passageway 60, primer chamber 50 and primer passageway 62, respectively. Therefore, airspace 25 is internally vented through choke bore region 49 of carburetor throat 47.

Primer bulb 52 has annular lip 66 disposed along an inner portion of bulb 52. Annular lip 66 is situated opposite surface 68 of primer limiter boss 57. During a priming operation of carburetor 10, primer bulb 52 is depressed by the operator. As shown in FIG. 3, when annular lip 66 engages surface 68, lip 66 acts as a check valve and closes off venting passageway 60 from variable volume primer chamber 50. Therefore, as the operator continues to depress bulb 52 in the direction indicated by the arrow in FIG. 3, a discrete volume of air is displaced from variable volume chamber 50 through priming passageway 62 into airspace 25. The increase in pressure generated in airspace 25 by this displaced volume of air acts upon fuel 21 in float bowl 20 and causes it to be forced upwardly into venturi region 46 of the carburetor to form a rich fuel/air mixture that is drawn into the intake manifold to aid in starting the engine. The sealing off of venting passageway 60 by check valve 66 prevents a loss of the priming charge through this passageway, and insures that substantially all of the priming charge passes into airspace 25 to perform useful work in forcing the fuel charge into venturi 46. As the operator releases primer bulb 52, the natural resiliency of bulb 52 causes it to return to its original position as shown in FIGS. 1–2. Venting passageway 60 is once again open and in communication with airspace 25, thereby providing a suitable vent for fuel bowl 20. The relatively large venting area provided by the annular sealing surface of the present invention virtually precludes the possibility that the vent will be obstructed by the type of contaminant dirt particles likely to be found in internally vented bowl carburetors of the type described herein.

While this invention has been described as having a preferred embodiment, it will be understood that it is capable of further modification. This application is therefore intended to cover any variations, uses or adaptations of the invention following the general principles thereof and including departures from the present disclosure as come within known or customary practice in the art to which this invention pertains and fall within the limits of the appended claims.

What is claimed is:

1. A carburetor for providing a fuel/air mixture to an internal combustion engine, said carburetor comprising:
- a carburetor body having a throat formed therein, said throat defining a fuel/air mixture passage through said body,
- a fuel supply bowl,
- conduit means for conveying fuel from said fuel supply bowl to said throat,
- a variable volume primer chamber,
- a priming passageway from said chamber to said fuel supply bowl,
- operator actuable primer means for abruptly varying the volume of said primer chamber and displacing a discrete volume of air from said chamber through said priming passageway into said fuel supply bowl,
- a venting passageway extending from said throat to said chamber, and
- valve means associated with said primer chamber for blocking the flow of air from the primer chamber through said venting passageway when the primer means is actuated to displace air through said priming passageway into said fuel supply bowl.

2. The carburetor of claim 1, wherein said venting passageway is in communication with said priming passageway.

3. The carburetor of claim 2, wherein said primer means comprises a flexible bulb, said bulb defining a portion of the periphery of said variable volume chamber, said bulb being adapted to be depressed to abruptly vary the volume of said chamber and displace said discrete volume of air from said chamber into said bowl.

4. The carburetor of claim 3, wherein said bulb is resilient, whereby the resiliency of said bulb causes said variable volume chamber to return to its pre-displaced volume.

5. The carburetor of claim 4, wherein said variable volume chamber includes a recessed area disposed in said carburetor body, and wherein said priming passageway extends from said recessed area to said bowl.

6. The carburetor of claim 1, wherein said primer means comprises a flexible bulb, and said bulb and primer chamber define said valve means.

7. The carburetor of claim 6, wherein said valve means comprises an annular lip disposed on an inner portion of said bulb and wherein said recessed area projects inwardly from a surface disposed on said carburetor body, said annular lip being aligned opposite said surface and having a circumference greater than the circumference of the opening defined by said recessed area so that when said bulb is depressed the annular lip engages said surface surrounding said recessed area, thereby sealing said venting passageway from the primer chamber.

8. A carburetor for providing a fuel/air mixture to an internal combustion engine, said carburetor comprising:
- a carburetor body having a throat formed therein, said throat including a fuel/air mixture passage through said body,
- a float regulated fuel supply bowl adapted to contain a quantity of liquid fuel and having an airspace above said fuel,
- a fuel nozzle for conducting fuel from said bowl to said fuel/air mixture passage,
- an air-filled variable volume primer chamber,
- a priming passageway extending from said variable volume chamber to said airspace,
- a flexible bulb defining a portion of said variable volume chamber, said bulb being adapted to be depressed to abruptly vary the volume of said chamber and displace a discrete volume of air from said chamber through said priming passageway into said airspace, and
- a venting passageway extending from said throat to said primer chamber, said venting passageway communicating with said primer passageway whereby said fuel supply bowl is vented to said throat.

9. The carburetor of claim 8, wherein said bulb is resilient, whereby the resiliency of said bulb causes said variable volume chamber to return to its pre-displaced volume.

10. The carburetor of claim 9, wherein said bulb and primer chamber include valve means for sealing said venting passageway from said primer chamber when the bulb is depressed, whereby the entirety of said displaced volume of air passes through said priming passageway into said airspace.

11. The carburetor of claim 10, wherein said variable volume chamber includes a recessed area disposed in said carburetor body, and wherein said priming passageway extends from said recessed area to said airspace.

12. The carburetor of claim 11, wherein said valve means comprises an annular lip disposed on an inner portion of said bulb, and wherein said recessed area projects inwardly from a surface disposed on said carburetor body, said annular lip being aligned opposite said surface and having a circumference greater than the circumference of the opening defined by said recessed area so that when said bulb is depressed the annular lip engages said surface surrounding said recessed area, thereby sealing said venting passageway from the primer chamber.

13. The carburetor of claim 8, whereby said flexible bulb is made from a rubber-like material.

14. A carburetor for providing a combustible fuel/air mixture to an internal combustion engine, said carburetor comprising:
- a carburetor body having a throat formed therein, said throat defining a fuel/air mixture passage through said body,
- a float regulated fuel supply bowl adapted to contain a quantity of liquid fuel and having an airspace above said fuel,
- a fuel nozzle for conducting fuel from said bowl to said fuel/air mixture passage,
- an air filled variable volume primer chamber, said chamber defined in part by a recessed area projecting inwardly from a surface on said carburetor body,
- a priming passageway extending from said recessed area of said chamber to said airspace,
- a venting passageway extending from said throat to said chamber, said venting passageway communicating with said primer passageway so that said fuel supply bowl is vented to said throat, and
- a flexible resilient manually operated bulb defining a portion of the wall of said chamber, said bulb being adapted to be depressed to abruptly vary the volume of said chamber and cause a discrete volume of air from said chamber to pass through said priming passageway into said airspace, said bulb further including valve means for sealing said venting passageway from said chamber when said bulb is depressed.

15. The carburetor of claim 14, wherein said valve means comprises an annular lip disposed on an inner portion of said bulb, said annular lip being aligned opposite said surface on said carburetor body and having a circumference greater than the circumference of the opening defined by said recessed area, so that when said bulb is depressed the annular lip engages said surface surrounding said recessed area, thereby sealing said venting passageway from the primer chamber.

* * * * *